US005150891A

United States Patent [19]

Svyatsky et al.

[11] Patent Number: 5,150,891

[45] Date of Patent: Sep. 29, 1992

[54] SHINGLE DEVICE FOR USE IN MULTI-PASS SORTING MACHINE

[75] Inventors: Eduard M. Svyatsky, Libertyville; George Paroubek, Downers Grove; Frederick P. Hegland, Des Plaines, all of Ill.

[73] Assignee: Bell & Howell Company, Skokie, Ill.

[21] Appl. No.: 736,427

[22] Filed: Jul. 26, 1991

Related U.S. Application Data

[62] Division of Ser. No. 501,556, Mar. 29, 1990, Pat. No. 5,119,954.

[51] Int. Cl.[5] ..... B65H 3/04

[52] U.S. Cl. ..... 271/35; 271/2; 271/122; 271/151; 271/157; 271/272

[58] Field of Search ..... 271/2, 10, 35, 151, 271/157, 3.1, 122, 165, 167, 272, 6, 7

[56] References Cited

U.S. PATENT DOCUMENTS

| | | | |
|---|---|---|---|
| 3,243,182 | 3/1966 | Dexter et al. . | |
| 3,378,251 | 4/1968 | Donabin . | |
| 3,622,149 | 11/1971 | Enskat | 271/35 |
| 3,776,544 | 12/1973 | Watson et al. | 271/35 X |
| 4,046,369 | 9/1977 | Kluge et al. | 271/151 X |
| 4,177,982 | 12/1979 | Bewersdorf et al. | 271/151 X |
| 4,369,959 | 1/1983 | Hornbuckle | 271/35 X |
| 4,666,141 | 5/1987 | Labombarde | 271/35 |
| 4,674,733 | 6/1987 | Pessina et al. | 271/35 X |
| 4,783,065 | 11/1988 | Graves, Sr. | 271/151 |
| 4,953,842 | 9/1990 | Tolmie, Jr. et al. | 271/35 X |
| 4,978,114 | 12/1990 | Holbrook | 271/35 |

FOREIGN PATENT DOCUMENTS

| | | | |
|---|---|---|---|
| 2348386 | 5/1974 | Fed. Rep. of Germany | 271/35 |
| 80337 | 1/1965 | German Democratic Rep. . | |

*Primary Examiner*—Robert P. Olszewski
*Assistant Examiner*—Boris Milef
*Attorney, Agent, or Firm*—Welsh & Katz, Ltd.

[57] ABSTRACT

A shingling device for use in a mail document sorting apparatus includes a first conveyor belt for receiving a vertical stack of sorted documents. A guide element is oblique to the conveyor belt for shifting the moving vertical stack into a shifted oblique stack and defines a gap between the belt and the guide element to enable passage of documents from the lower portion of the stack. A rotatable roller is disposed adjacent and downstream from the guide element and has a lower surface partially obstructing the gap. The roller rotates opposite to movement of the first conveyor belt for shingling documents passing through the gap. A second conveyor belt cooperates with the first conveyor belt to confine shingled documents advancing on the first belt, and cooperates with the roller so that the second belt has a longitudinal velocity substantially equal to the tangential velocity of the roller.

14 Claims, 6 Drawing Sheets

SHINGLE DEVICE FOR USE IN MULTI-PASS SORTING MACHINE

This is a division of application Ser. No. 501,556 filed Mar. 29, 1990, now U.S. Pat. No. 5,119,954.

FIELD OF THE INVENTION

This invention relates to a sorting machine for use in the sequential sorting of mail identified for delivery by an individual carrier. In an urban area there are generally in excess of three thousand pieces of mail and over one thousand delivery points for each daily individual carrier delivery route. The time for sequencing of mail in pouch (actually fibre-board mail trays) for an individual carrier can be measured in a reduction of several hours when the sorting machine contemplated by the present invention is utilized.

The theory of operation of the present invention is to utilize a two-pass system for the delivery sequence sortation of mail handled by the local carrier. The two-pass method of sortation described herein can be used for both the 33 sort stacker and the 66 sort stacker Carrier Sequence Bar Code Sorter (hereinafter referred to as CSBCS and where the term "Sequence" relates to the sequential arrangement of the stops on a single carrier's delivery route).

This two-pass sortation system was devised to allow for a delivery sequencing of mail using a minimum number of sort stackers to give the maximum number of sortation separations. The two-pass system requires that all mail pieces fed into the CSBCS, for a particular carrier sort run, be read by the CSBCS bar code reader twice. The initial reading of the bar code (the "1st Pass") will occur as an operator feeds the mail pieces into the CSBCS. After all mail has been fed by the operator, and sorted to the sort stackers, the CSBCS will automatically recirculate the mail, using the correct sort stacker sequence, past the bar code reader a second time(giving the "2nd Pass"). The mail will again be sorted to the sort stackers, at which point the mail will be in proper delivery sequence. Described herein is a two-pass sortation system using 33 stackers for both the first and second passes of mail. While this is the system given as the illustrative embodiment, any future production machines may require an expansion on the number of sort stackers used for this illustrative embodiment, to allow for an increased number of sortation separations Any sort program generation of programs for the CSBCS using the two-pass system, must be configured to allow an expansion of the number of sort stackers, without drastic changes to existing sort programs.

In a two-pass system, the CSBCS will use the first pass of mail to distribute mail pieces in such a manner that when the mail is processed through a second pass, and each sort stacker buffer (containing mail from the first pass) is processed in sequence, the mail will be in the proper delivery sequence. A system that uses 33 sort stacker buffers for the first pass and 33 sort stacker buffers for the second pass is referred to as a Module 33 system. Similarly, if the system is expanded to include 50 sort stacker buffers, then it is a Module 50 system

BACKGROUND OF THE INVENTION

Attempts have been made to provide sorters for use by individual carriers. However, since the theory of sorting utilized in such equipment required multiple passes it was necessary for the carrier to manually remove sorted material from bins (called "sweeping") and return the sorted letters back to the original sorting apparatus This was not only cumbersome but also often resulted in breakdown of the sort and hence would require another first or second sort on the disassembly of the order of the sorted letters.

OBJECTS AND THEORY OF THE PRESENT INVENTION

The theory of operation of the present invention is to utilize a two-pass system for the delivery sequence sortation of mail handled by the local carrier. The two-pass method of sortation described herein can be used for both a 33 sort stacker and the 66 sort stacker Carrier Sequence Bar Code Sorter (hereinafter referred to as CSBCS and where the term "Sequence" relates to the sequential arrangement of the stops on a single carrier's delivery route).

This two-pass sortation system was devised to allow for a delivery sequencing of mail using a minimum number of sort stackers to give the maximum number of sortation separations. The two-pass system requires that all mail pieces fed into the CSBCS, for a particular carrier sort run, be read by the CSBCS bar code reader twice. The initial reading of the bar code (the "1st Pass") will occur as an operator feeds the mail pieces into the CSBCS. After all mail has been fed by the operator, and sorted to the sort stackers, the CSBCS will automatically recirculate the mail, using the correct sort stacker sequence, past the bar code reader a second time(giving the "2nd Pass"). The mail will again be sorted to the sort stackers, at which point the mail will be in proper delivery sequence. Described herein is a two-pass sortation system using 33 stackers for both the first and second passes of mail. While this is the system given as the illustrative embodiment, any future production machines may require an expansion or a reduction on the number of sort stackers used for this illustrative embodiment, to allow for an increased or decreased number of sortation separations, as circumstances require. Any sort program generation of programs for the CSBCS using the two-pass system, must be configured to allow an expansion of the number of sort stackers, without drastic changes to existing sort programs.

In a two-pass system, the CSBCS will use the first pass of mail to distribute mail pieces in such a manner that when the mail is processed through a second pass, and each sort stacker (containing mail from the first pass) is processed in sequence, the mail will be in the proper delivery sequence. A system that uses 33 sort stacker buffers for the first pass and 33 sort stacker buffers for the second pass is referred to as a Module 33 system. Similarly, if the system is expanded to include 50 sort stacker buffers, then it is a Module 50 system.

The following is a simplistic example of two-pass system. Although this example uses four sort stackers for the first pass and thirteen sort stackers for the second pass, as opposed to the required 33 sort stackers for the first pass and 33 for the second pass, as mentioned above, the theory is still the same.

An operator who wishes to can use the CSBCS to sort a deck of playing cards (52 cards, excluding Jokers) by number, then color, and then icon in just two passes. After the two-pass sort, the desired order is:

#1. 2 of Diamonds (red), 2 of Hearts (red), 2 of Clubs (black), and then the 2 of Spades (black);

#2. 3 of Diamonds (red), 3 of Hearts (red), 3 of Clubs black), and then the 3 of Spades (black); . . . etc. (4–10, J,Q, K,) up to . . .

#13. Ace of Diamonds (red), Ace of Hearts (red), Ace of Clubs (black), and then the Ace of Spades (black).

The Operator feeds a shuffled deck of cards into the CSBCS, which in turn sorts (first pass) all Diamonds (red) to the first sort bin, all Hearts (red) to the second sort bin, all Clubs (black) to the third sort bin, and all Spades (black) to the fourth sort bin. After all 52 cards have been sorted through the first pass, the CSBCS automatically recirculates the cards (hence the second pass) to a second set of 13 sort bins. During the second pass, the CSBCS processes all cards in the first sort bin (of the initial set of four sort bins) and distributes the 2 of Diamonds to the first sort bin, the 3 of Diamonds to the second sort bin, etc. up to the Ace of Diamonds to the Thirteenth sort bin. Similarly, after all cards from the first sort bin have been processed a second time, the CSBCS will process all cards contained in the second sort bin (Hearts), and distribute the cards (in the same manner as for the second pass for Diamonds) on top of the Diamonds to the set of thirteen sort stackers. The CSBCS will continue to process the second pass with sort bin #3 (Clubs) and then sort bin #4 (Spades), until all cards from the initial set four stackers have been properly sorted to the set of thirteen stackers. After the second pass is complete, the CSBCS automatically unloads the cards from the second set of thirteen stackers, with bin#1 first, then bin#2, etc., through bin#13, last, to an output stacker. All the operator need do is pick up the 52 cards, now in the desired order, from the output stacker.

There is not much difference between this card sort example, and a two-pass system used to sort a carrier's mail into delivery walk sequence. In the sort card example, the CSBCS uses 4 sort stackers and then 13 sort stackers to sequence the cards, and this allows for $4\times13=52$ possible separations. Similarly, a two-pass system that uses 33 sort stackers and then 33 sort stackers to sequence mail, gives $33\times33=1089$ possible separations. This two-pass system for carrier sequencing would look as follows:

After the first pass, mail will be distributed to the 33 sort stackers so that, sort bin #1 contains all mail for the 1st, 34th, 67th . . . through 1057th delivery stop, sort bin #2 contains all mail for the 2nd, 35th, 68th . . . through . . . 1058th delivery stop, . . . etc., through sort bin #33, which contains all mail for the 33rd, 66th, 99th . . . through the 1089th delivery stop.

After the first pass is complete, a second pass of mail will be performed. During the second pass the CSBCS will sort all of the mail from sort bin#1 first, then all of the mail from sort bin#2 next, etc., in bin sequence, ending with sort bin#33. After the second pass, mail will be distributed to the 33 stackers such that, second pass sort bin#1 will contain all of the mail for the 1st delivery point on top of which will be all of the mail for the 2nd delivery point, etc. up to all of the mail for the 33rd delivery, second pass sort bin#2 will contain all of the mail for the 34th delivery point on top of which will be all of the mail for the 35th delivery point, etc., up to all of the mail for the 66th delivery, . . . etc., through second pass sort bin#33, which will contain all of the mail for the 1057th delivery point on top of which will be all of the mail for the 1058th delivery point, . . . etc., up to all of the mail for the 1089th delivery point.

The basic approach of the present invention is to utilize belt means for controlled machine handling of all of the mail, to eliminate all operator handling or sweeping, between the initial manual introduction into an input feed and singulation means until the mail is sorted in the desired sequential relation and automatically fed into mail trays for loading into the delivery vehicle or carrier bag.

The actual sorting is accomplished by a bar code reader and associated electronics and computer chip means. The bar code reader (BCR) reads the whole 11-digit code and then translates the code into, a number from 1 to 1089, each number of which identifies a separate delivery point or stop, which bears no relation to the zip code. The individual postman carrier determines how he wants to deliver, and he establishes his own route and determines the stop numbers. After he has picked the sequence of numbers that come out after sorting, the post office assigns one of the numbers from 1 to 1089 to each stop. The eleven digit zip code is placed on the envelope by the post office and is obtained from a national look-up directory, with another machine adding the eleven digit zip to the envelope. The present 9-digit zip code gets you to one side of a particular block on a particular street, while the 11-digit zip code gets you directly to a particular stop or house. The stop numbers assigned by the postman permit him to go back and forth across a street or to follow one side of the street, according to his own personal preference for delivery. Thus, the zip codes serve the function of directing the mail to a particular sub-station, while the sequence of stop numbers are representative of the personal wishes of a particular carrier in relation to the stop points assigned to him. The equipment contemplated by the present invention utilizes an indicia reader, either bar code or character, to read the bar code and then, through electronic and/or computer means, assigns a stop number for sorting purposes.

DETAILED DESCRIPTION

Figure 1:
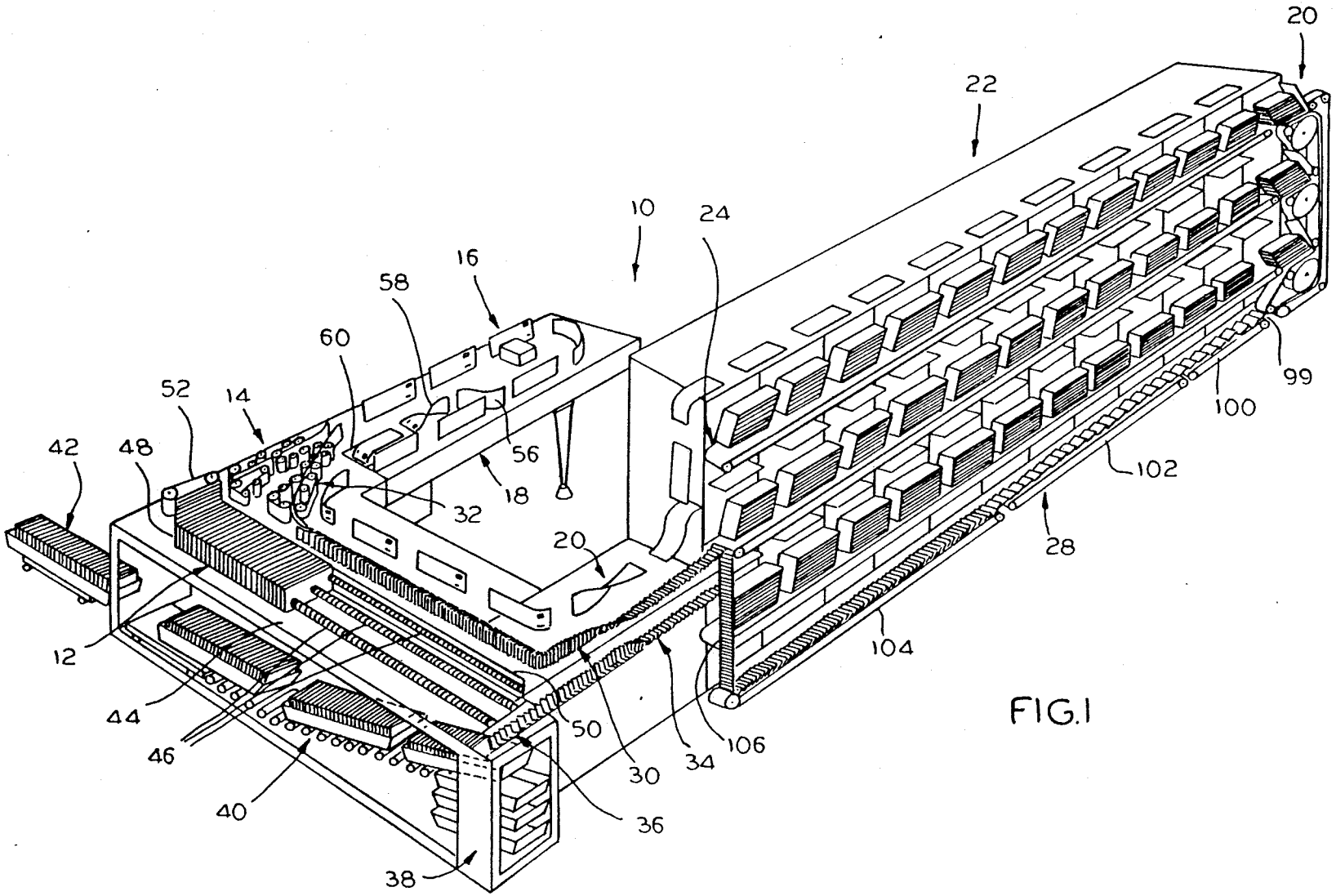
FIG. 1 is schematic perspective view of a sorting machine embodying the teachings of the present invention.

Referring now to the drawings, wherein similar parts are designated by similar numerals, and particularly to FIG. 1, the system contemplated by the present invention is embodied in the sorter 10. Such a sorter 10 includes a document input feed means 12, a first pass singulation means 14, indicia reading means 16, separation and segregation means 18, orientation and conversion means 20, sorter mechanism 22, belt discharge mechanism 24, shingler means 26, shingled document transport means 28, flow path 30 for orienting shingled documents for the second pass, second pass singulation means 32 for second pass reading by indicia reading means 16, discharge path 34 for vertically orienting second pass sequentially sorted documents, loading means 36 for sequentially sorted documents, tray elevation means 38, conveyor rollers 40 for filled mail trays; and a discharged tray on dolly 42.

The document input feed means 12 follows a normal pattern for such devices. In this embodiment, an elongated generally planar tray means 44 includes a trio of auger type means 46, with two such means 46 underlying the edge-stacked letters 48 and a third means 46 extending along a vertical sidewall 50 against which the end edge of the vertical envelopes 48 are abutted. The first or lead letter is moved laterally from the front of the stack by belt means 52 to deliver such lead letter to the singulator 14 which can be one of several designs for such purposes. Such singulators insure that only a single letter is withdrawn sequentially from the front of the stack 48, settled to the plane of the belt surface that it is riding on and then singly presented to the indicia reading means 16 for either bar code or character reading and signal generation for sorting purpose identification. The signal is transmitted to electronic/computer chip means, not shown.

Figures 2, 3, 4:
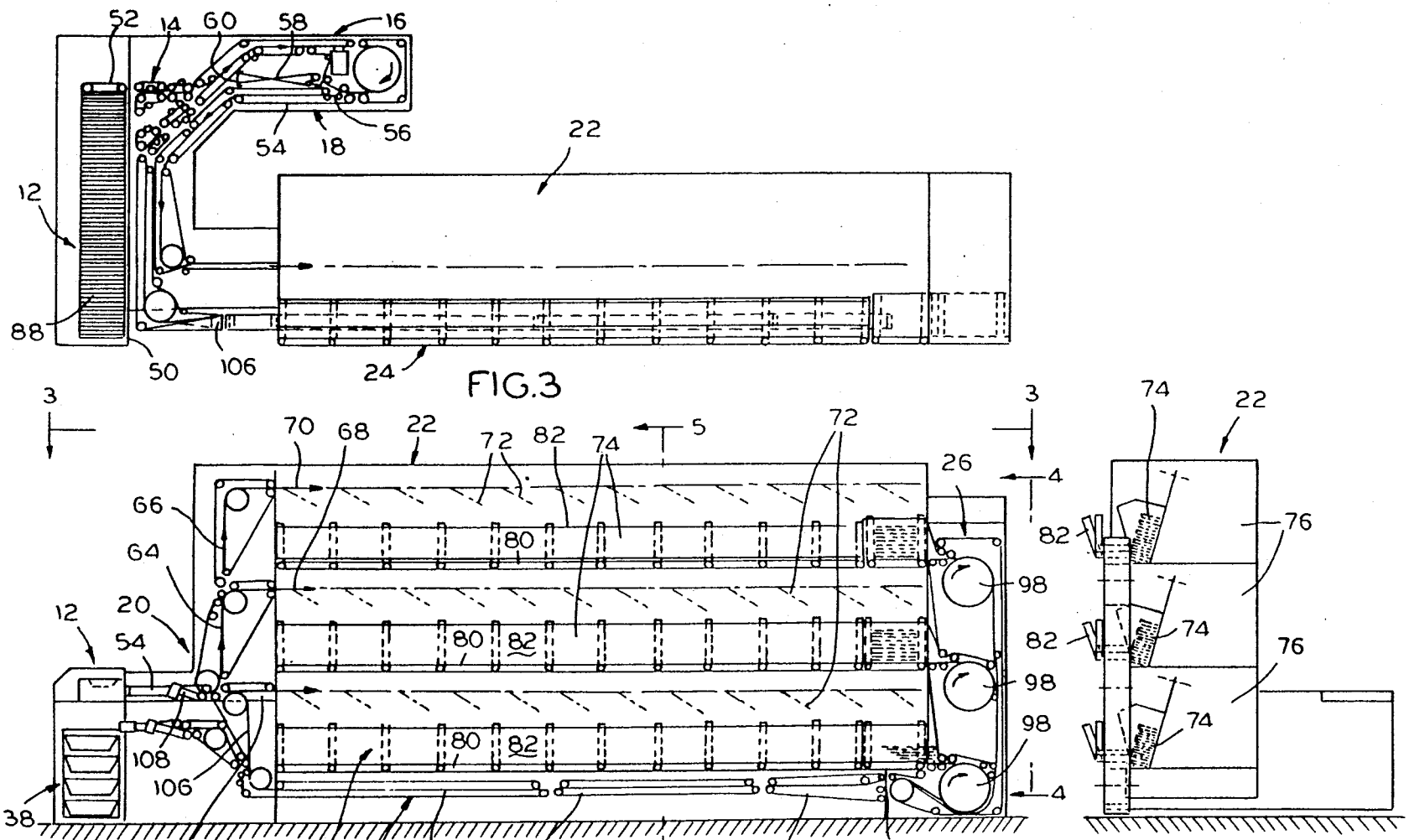
FIG. 2 is a front elevation view of the device shown in FIG. 1.
FIG. 3 is a top plan view of the device as taken along line 3—3 in FIG. 2.
FIG. 4 is an end elevational view of the device as taken along line 4—4 in FIG. 2.

As best seen in FIGS. 1–3, the letters are then fed by belt means 54 (FIGS. 2 and 3), if acceptable, or if not identifiable, the letters are diverted by means 56 (FIGS. 1 and 3), translated by means 58 to a flat position (FIGS. 1 and 3), and discharged by means 60 (FIGS. 1 and 3) through an opening to a container means below, not shown. The belt system 54 continues around to the orientation and conversion means 20 which, as best seen in FIG. 2, segregates and diverts the identified mail, either directly ahead via belt means 63 to the lower tier of bins 62, or upwardly by belt means 64 to the center tier of bins 68, or further upwardly by belt system 66 to the top tier of bins 70. The signal generated by the indicia reading means 16 as interpreted by the electronic/computer means, not shown, directs the particular letter by proper signal instructions to the correct belt means 63, 64 or 66. The electronic/computer means also supplies the necessary signals for operation of the diverter or gate means 72 which are shown in phantom above each individual bin 74 within the tiers of bins 62, 68 and 70 in the sorter 22.

Figure 5:
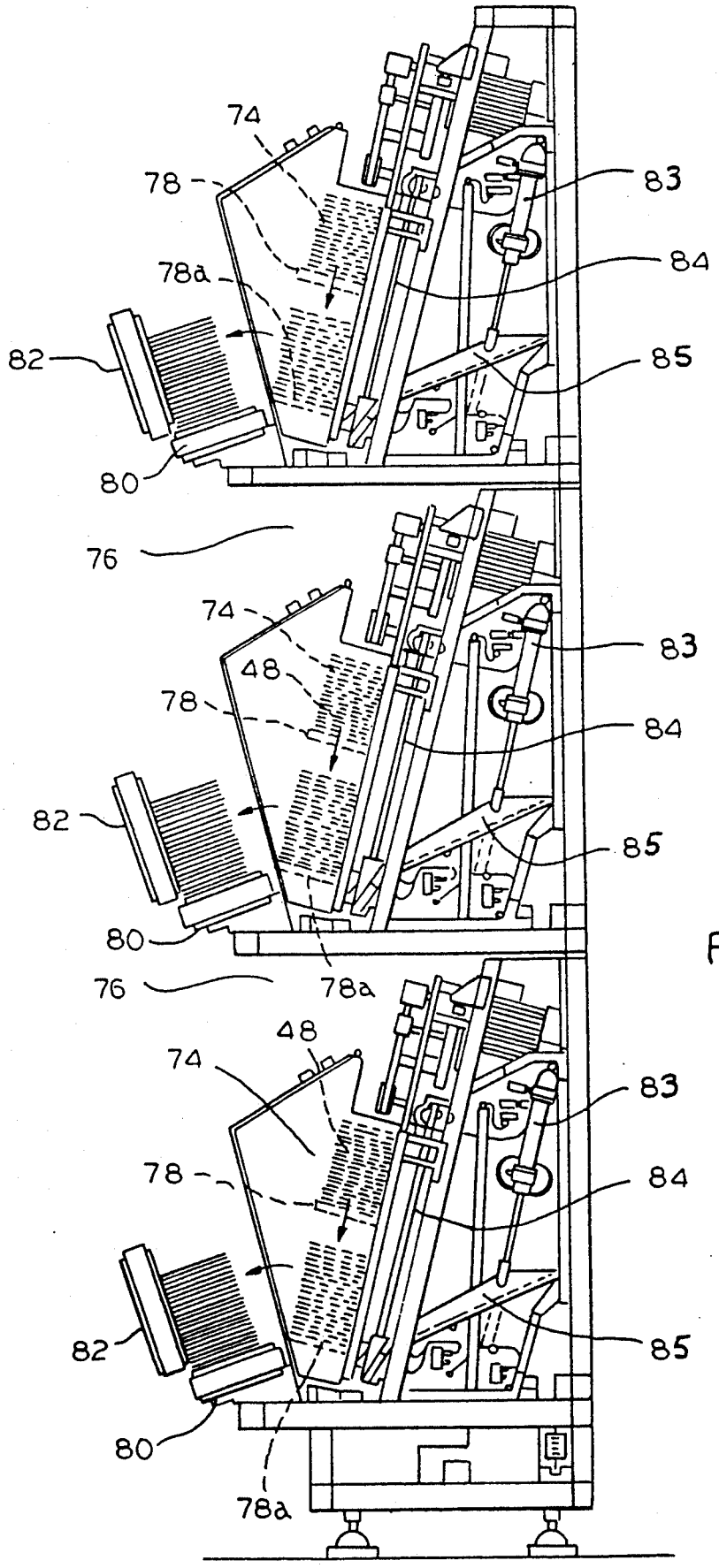
FIG. 5 is a schematic cross-sectional elevational view of the bin discharging mechanism as taken generally along line 5—5 of FIG. 2.

Each bin 74 is located within a chamber 76 within sorter 22, this being best illustrated in FIGS. 4 and 5. As the letters are distributed to the various bins 74, the letters 48 are positioned on a cantilever shelf-like member 78. When the shelf 78 reaches a maximum supporting capacity, it is lowered hydraulically to the lower position designated 78*a*.

Positioned in front of each row of chambers 76 are a pair of normally disposed belts, 80 and 82, with the lower belt 80 being transversely disposed in an outwardly and downwardly extending angled relationship relative to the bins 74. The second belt 82 extends upwardly substantially perpendicular to the outside edge of belt 80. These belts run the entire length of the sorter 22 and terminate at the far end (or right hand end in the drawings) at a shingler means 26, as will be further described hereinafter.

The shelves 78 in the bins 74 are moved up and down by screw means 84. When the shelves 78 are full, they are tipped out of the chamber 76, as seen by the arrows in FIG. 5, and the stack of letters 48 is hereby dumped as a stack onto the lower belt 80, with the outer edges of the letters 48 abutting and supported by belt 82. The tipping of the lowered shelf 78*a* is accomplished by the hydraulic means 83 and its attached lever system 85.

Figure 7:
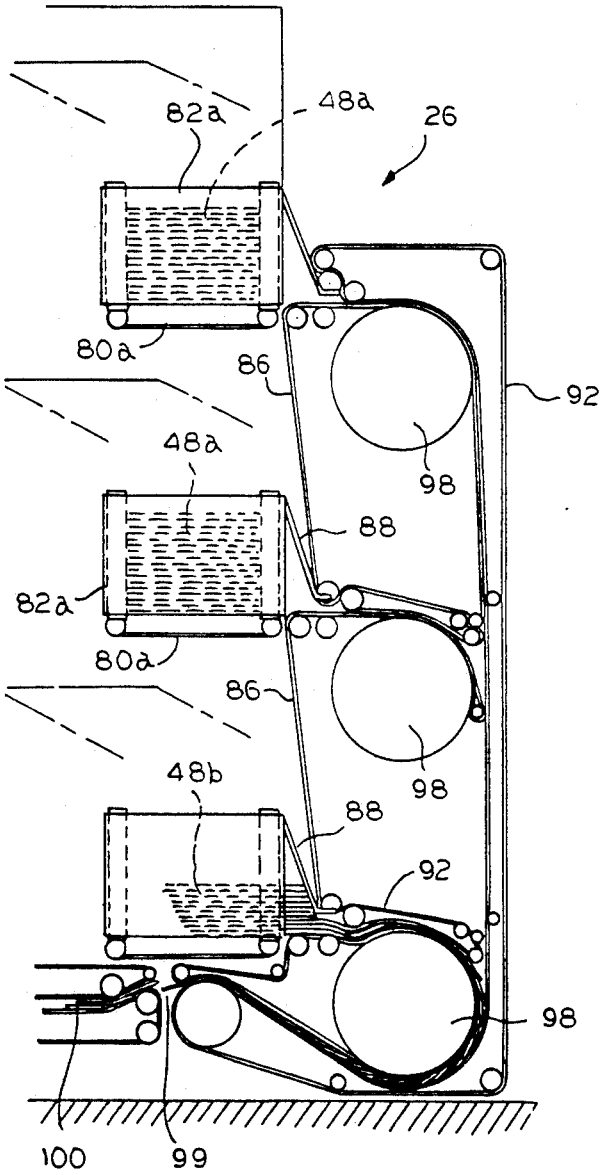
FIG. 7 is an enlarged partial view of the right hand end of the view shown in FIG. 2, showing the shingler stations for the three tiers of bins.
Figure 6:
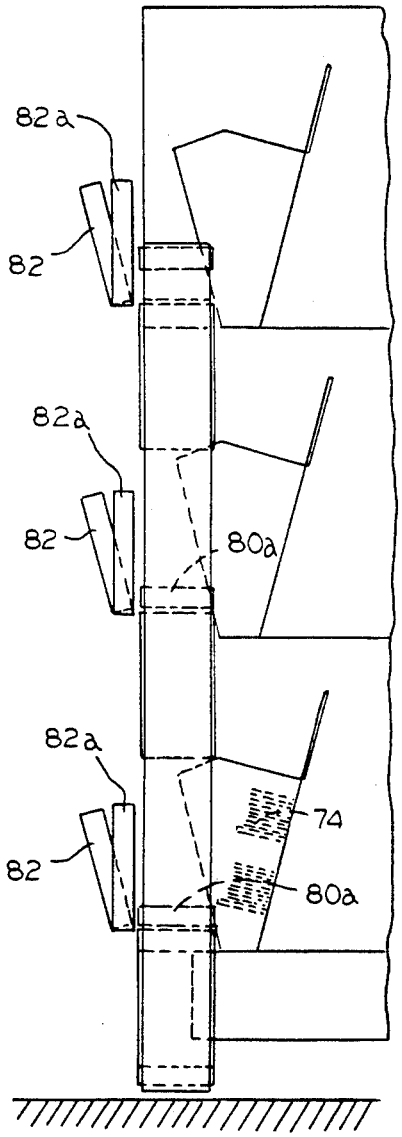
FIG. 6 is an enlarged partial view of FIG. 4.

As the stack contents of individual bins 74 are discharged onto the belt 80, they are moved to the far or right end, as seen in FIGS. 1 and 2, and are brought into position for action by the shinglers 26. As seen in FIGS. 6 and 7, each load of stacked letters abutting a vertically angled outer belt 82 is brought into a positive vertical disposition by engaging a short belt 82*a*, and as this load is carried on the horizontally angled lower belt 80, it is brought into a true horizontal disposition by being transfered to a short belt 80*a* so that the stack of letters 48*a* is squared relative to the action of shingler 26.

Figure 10:
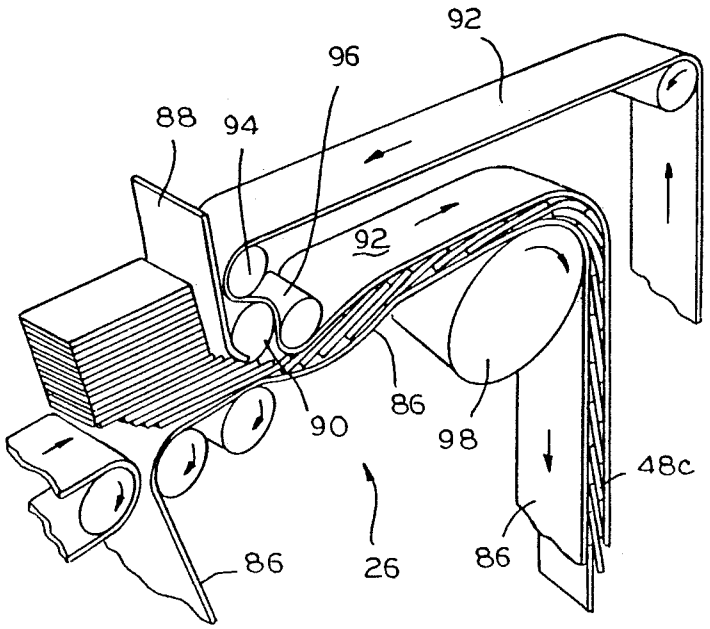
FIG. 10 is a perspective view from the upper left position relative to the partial view of the device shown in FIG. 8.
Figure 8:
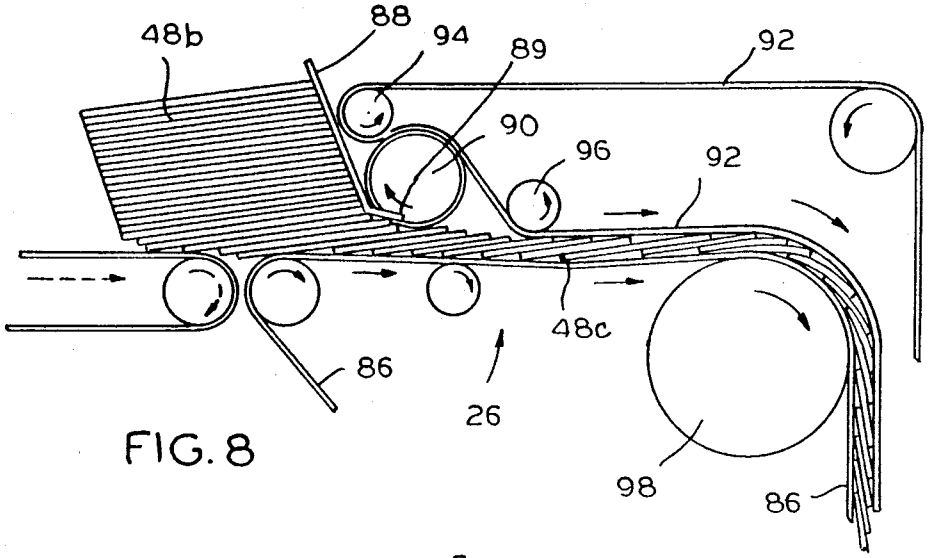
FIG. 8 is a schematic partial elevational sectional view of the shingler mechanism.
Figure 9:
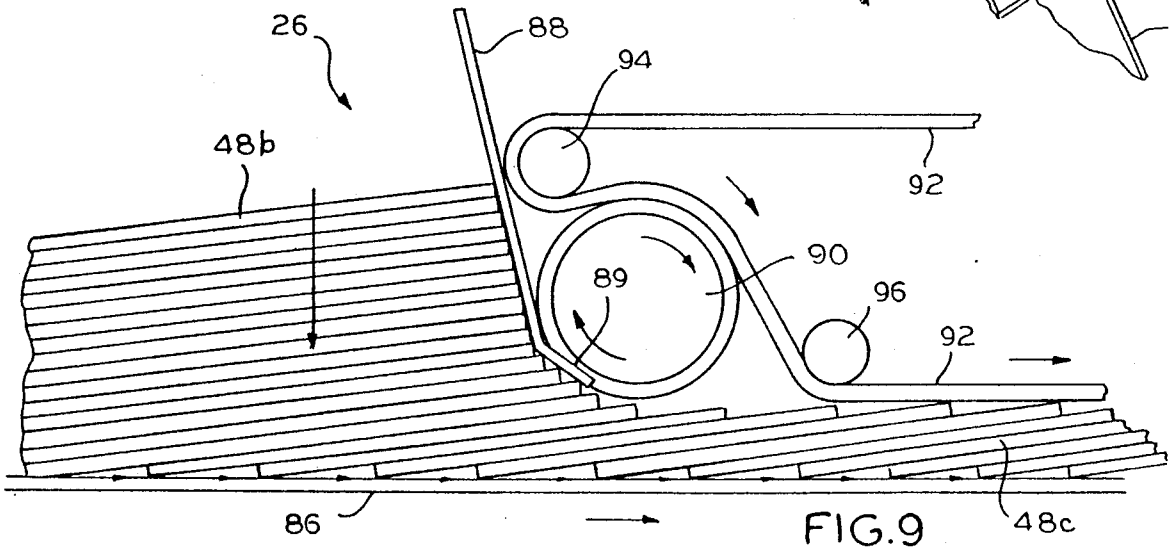
FIG. 9 is an enlarged detail view of a portion of the mechanism shown in FIG. 8.

As best seen in FIGS. 8–10, the bin load 48*a* (shown vertically stacked in FIG. 7) is moved by belt 80*a* until the forward end of said load 48*a* engages belt 86 and is drawn into a slanting configuration 48*b* by the action of long belt 86 and the reversely slanted guide 88. Guide 88 is curved away, as at 89 in FIG. 9, from the stack 48*b* and slotted to accomodate an enlarged roller 90. Roller 90 is rotating in opposition to the ejection of letters from under the guide 88 to measure and determine the amount of letters permitted to be ejected. While the belt 86 supports the lower side of the letters 48*b*, a belt 92 engages the upper side of roller 90 and the under side wrap-around side or of rollers 94 and 96 to thereby grip the upper side of the shingled stream of letters 48*c*. This permits the stream 48*c* to be drawn over an enlarged roller 98 and moved vertically downwardly until the stream is ejected from the shingler mechanism at 99 (in FIGS. 1 and 2) for transportation on belt systems 100, 102, and 104. As seen most clearly in FIG. 2, belt systems 100, 102, and 104 each comprise a pair of belts for holding the shingled letters therebetween. Further upward transportation of the shingled letters is achieved by belt system 106 for translation at 108 by means 30 for a second pass, by then going through the second pass singulator 32 where the letters are positioned singly and properly for a further second pass reading by the indicia reading means 16.

After the letters have gone through the second pass and sorting procedure, the bins are sequentially emptied onto the belts 80 and 82, and the stacked letters are shingled for transportation from the tiers of bins. Referring now to FIGS. 11-14, the sequentially shingled letters 48*c* are fed through the angularly reorienting mechanism 34 (FIG. 1) and fed off of a laterally extending belt means 110 (FIG. 13) into the upper mail tray 112. When the tray 112 is, filled the gate 142 (FIG. 12) is opened and tray 112 rolls down the roller conveyor 40 to a waiting dolly 42. An empty tray 116 is introduced at the lower end of tray raising means 38 after the mechanism has raised the other two empty trays 118 and 120.

Figure 12:
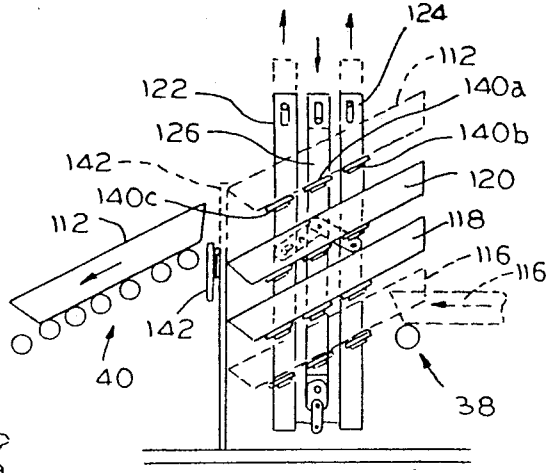
FIG. 12 is a schematic partial cross-sectional elevational view of the tray positioning mechanism utilized in the mail tray loading means of FIG. 11.
Figure 13:
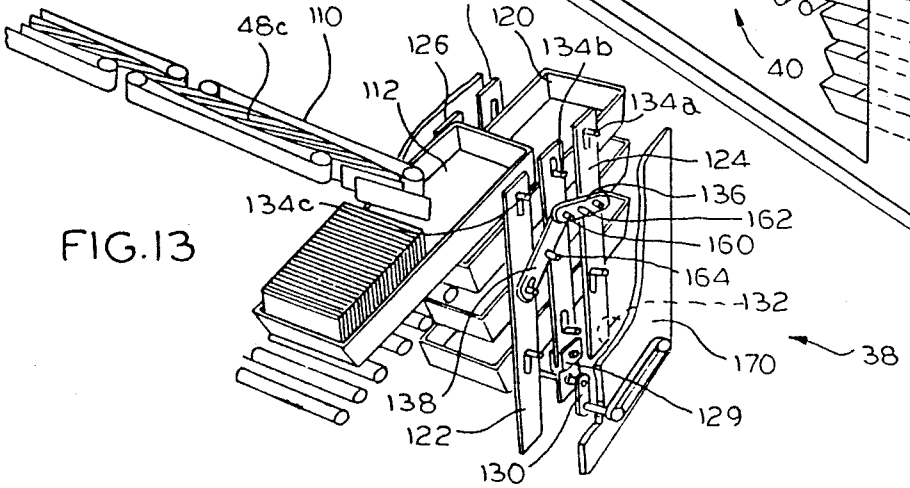
FIG. 13 is an exploded perspective view of the tray positioning mechanism shown in FIG. 12 along with the mechanism for shingled delivery of mail into a mail tray.

As best seen in FIG. 13, the tray raising mechanism 38 includes a plurality of parallel slideable strips 122 and 124 on the outboard positions and central strip 126 intermediate the other two. The central strip 126 is equipped at its lower end with a yoke means 129, a bell crank 130 and a power means 132. When the bell crank 130 causes the central strip to move downwardly, as best seen in FIG. 12, the outboard strips 122 and 124 are caused to move upwardly by reason of the linkage arms 136 and 138 (FIG. 13) centrally pivotably hinged as at 160. The pivot pins 162 and 164, along with the pins 134*a*, 134*b*, and 134*c* are fixed to the sidewall 170 of the structure, whereby when the pivot 160 is pulled downwardly by the central strip 126, the outer free ends of linkage arms 136 and 138 are caused to move upwardly and thereby cause the outboard arms 122 and 124 to also move upwardly, as seen in the drawing.

Figure 14:
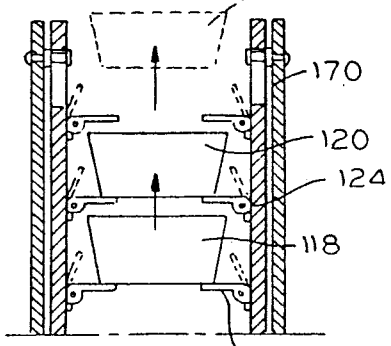
FIG. 14 is a schematic partial cross-sectional elevational view of the moveable support means utilized in the tray positioning mechanism shown in FIGS. 12 and 13.
Figure 11:
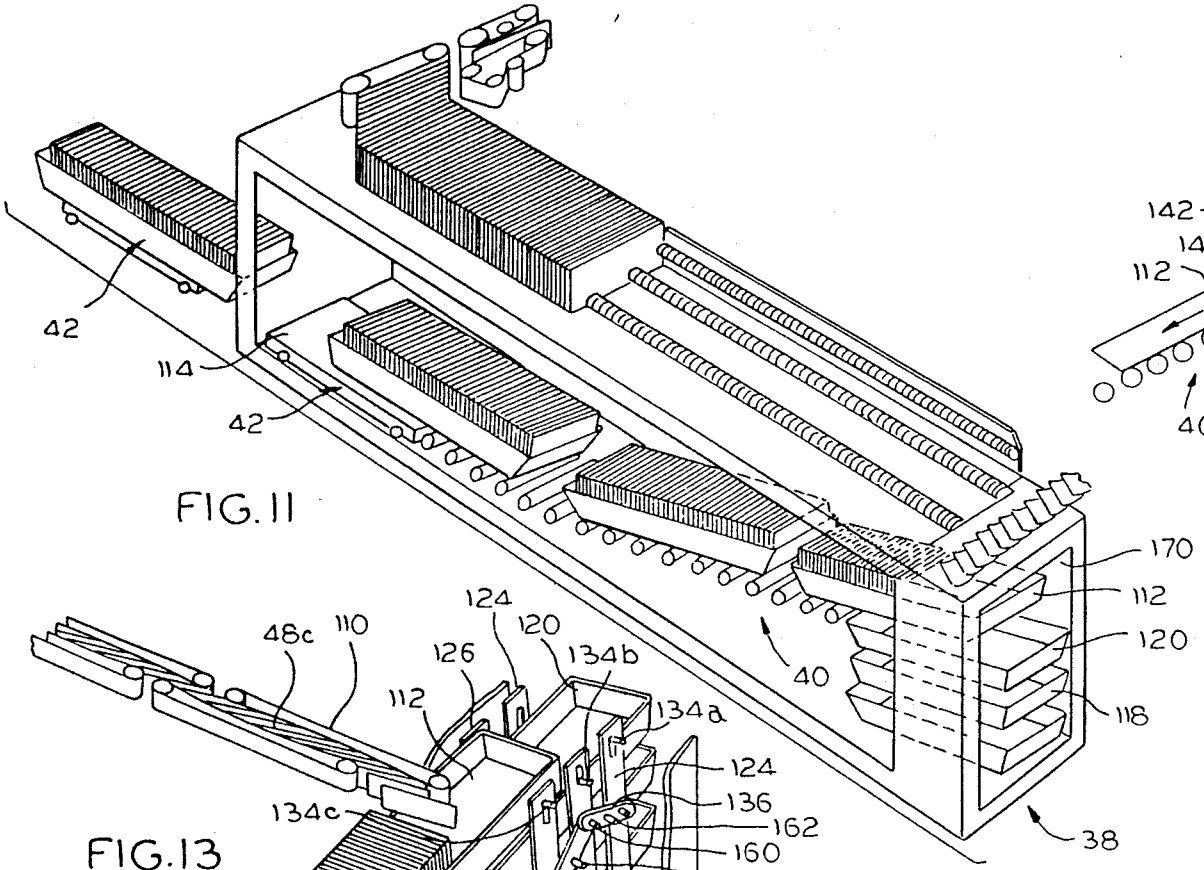
FIG. 11 is a schematic perspective view of a portion of the device of FIG. 1 showing the document input loading elements on the upper level, and the shingled loading of sorted mail into mail trays on the lower level.

It should be pointed out that a mirror image of this strip, pin, and linkage configuration exists on the opposite side of the tray raising mechanism. As these raising and lowering actions occur, the strips carry inwardly directed pivoted shelves 140 which are rotatably upwardly as seen in FIG. 14. As tray 112 is discharged by the opening of gate 142, the central strips 126 move downwardly, thereby causing gate 140*a* to flip upwardly, as seen in phantom in FIG. 14, and slide down the side of tray 120 until the shelf 140*a* moves past the bottom of tray 120. The shelf then drops to the horizontal position and permits the strip to move upwardly again whence the outboard shelves 140*b* and 140*c* will do the same thing and the second tray 120 will be in the secure upper position and available for accepting shingled mail. A new tray 116 is introduced in the empty lower position (FIG. 12) and the cycle is then repeated until complete sorting is accomplished.

I claim:

1. A shingler device for documents, suitable for use in a mail sorting apparatus, comprising, in combination, first movable belt means for receiving a vertically stacked array of documents from a document source and conveying said documents along a path defined by a movable reference plane, second movable belt means defining a reach adapted to receive the stack of documents from a terminal end of said first belt means and continue movement of the documents along the path, upstanding guide means for confronting said documents and having a lower end overlying and spaced above said reference plane to define a gap enabling passage of documents from the lower portion of the stack, rotatable roller means having a lower tangential surface adjacent said lower end of said guide means and spaced above said reference plane but below said lower end of said guide means, said roller means being rotatable such that said tangential surface moves in a direction opposite to the direction of movement of documents passing through said gap and causes shingling of documents passing through said gap, and third movable belt means cooperative with said second belt means downstream from said roller means to receive shingled documents from said gap, said third belt means being drivingly interconnected with said roller means so that said third belt means has a longitudinal velocity substantially equal to the tangential velocity of said roller means.

2. A shingler device as claimed in claim 1 wherein said second belt means is operative to engage one face of said documents, said third belt means being operative to engage the opposite face of said shingled documents.

3. A shingler device for use in sorting generally flat documents in a mail sorting apparatus, said shingler device comprising, in combination, first movable means including a movable first conveyor belt for receiving a vertical stack of generally flat documents on an upper surface thereof, a guide element vertically oblique to the upper surface of the first belt for shifting the vertical stack into a vertically oblique stack having a vertically oblique axis, said guide element having a lower end spaced above the upper surface of said movable first belt so as to define a gap therebetween, second moveable means comprising a rotatable roller downstream of said guide element and adjacent thereto, said roller having a lower surface partially obstructing said gap and movable in a direction opposite to the direction of first belt movement, motive means for moving said first and second movable means to cause shingling of documents passing through said obstructed gap from the bottom of said oblique stack and advance said shingled documents on the upper surface of said first belt, and third movable means comprising a second belt opposed to said first belt and advancing therewith in a manner to confine shingled documents advancing on said first belt, said opposed second belt advancing in movable contact with the rotating upper surface of said rotatable roller.

4. A shingler device according to claim 3 wherein said partially obstructed gap provides an opening sufficient to allow a plurality of planar documents to pass therethrough substantially simultaneously from the bottom of said oblique stack to provide said advancing shingled documents.

5. A shingler device according to claim 4 wherein said stack of generally flat documents passes through said partially obstructed gap sequentially to provide said shingled documents advancing on said first belt.

6. A shingler device according to claim 3 wherein the upper end of said guide element extends above the upper surface of said vertical stack advancing on said first belt.

7. A shingler device according to claim 3 further including additional movable means for receiving a second vertically oblique stack of documents having a second oblique vertical axis different from said first oblique vertical axis, and for shifting said second vertical oblique stack into said vertical stack for delivery as input to said first belt.

8. A shingler device according to claim 7 wherein said additional movable means comprises a third movable belt means having an output end coplanar and adjacent to the input end of said first belt.

9. A shingler device for generally planar articles, suitable for use in sorting documents in a mail sorting apparatus, which comprises, in combination:

a. first movable means comprising a first belt means for receiving a vertically stacked array of generally planer articles as an input upon its upper surface, said first belt means having an inlet end and an outlet end;

b. first motive means advancing said vertically stacked array on said first belt means from said inlet end to said outlet end by moving said belt means in a first direction;

c. a guide element vertically oblique to the upper surface of said first belt means for causing said vertically stacked array advancing on said first belt means to be shifted into a first vertically oblique stacked array having a first oblique vertical axis, said guide element having an upper end spaced above said upper surface and oriented toward said inlet end, and having a lower end spaced above and adjacent said upper surface and oriented away from said inlet end to provide a predetermined gap between said guide element and said upper surface;

d. second movable means including a rotatable roller spaced above said first movable belt means and adjacent the lower end of said guide element with said guide element located between said roller and the inlet end of said first movable belt means, said roller having a movable lower surface below the lower end of said guide means to partially obstruct said gap;

e. second motive means for rotating said roller in a direction opposite to said first direction so as to cause articles to pass sequentially through said gap from the bottom of said stack in a shingled array on said first movable belt means, and f. second movable belt means opposed to said first belt means and confining said shingled array of articles against said first belt means, said opposed second belt means advancing in movable contact with the rotating upper surface of said rotatable roller.

10. A shingler device according to claim 9 wherein said partially obstructed gap provides an opening sufficient to allow a plurality of planar articles to pass therethrough substantially simultaneously from the bottom of said oblique stacked array to provide said advancing array of shingled planar articles.

11. A shingler device according to claim 10 wherein said plurality of planar articles passes through said partially obstructed gap sequentially to provide said shingled array of planar articles advancing on said first belt means.

12. A shingler device according to claim 9 wherein the upper end of said guide element extends above the upper surface of said vertically stacked array advancing on said first belt means.

13. A shingler device according to claim 9 further including an additional movable means for receiving an input of a second vertically oblique stack of planar articles having a second oblique vertical axis different from said first oblique vertical axis, and for shifting said second vertically oblique stacked array into said vertically stacked array for delivery as said input to said first belt means.

14. A shingler device according to claim 13 wherein said additional movable means comprises a third movable belt means having an output end coplanar and adjacent to the input end of said first belt means.

* * * * *